US006820577B2

(12) United States Patent
Yamada

(10) Patent No.: US 6,820,577 B2
(45) Date of Patent: Nov. 23, 2004

(54) ENGINE OF COMPRESSION-RATIO VARIABLE TYPE

(75) Inventor: Yoshikazu Yamada, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/689,519

(22) Filed: Oct. 21, 2003

(65) Prior Publication Data

US 2004/0134452 A1 Jul. 15, 2004

(30) Foreign Application Priority Data

Oct. 29, 2002 (JP) ..... 2002-313706
Oct. 29, 2002 (JP) ..... 2002-313707
Oct. 29, 2002 (JP) ..... 2002-313708

(51) Int. Cl.[7] ..... F02B 75/04
(52) U.S. Cl. ..... 123/48 B; 123/78 F; 123/185.14
(58) Field of Search ..... 123/48 B, 78 F, 123/185.14

(56) References Cited

FOREIGN PATENT DOCUMENTS

| | | |
|---|---|---|
| DE | 42 26 361 A1 | 4/1994 |
| GB | 321684 | 11/1929 |
| JP | 9-228858 | 2/1997 |
| JP | 2002276446 | 9/2002 |

*Primary Examiner*—Noah P. Kamen
(74) *Attorney, Agent, or Firm*—Arent Fox, PLLC.

(57) ABSTRACT

In an engine of a compression-ratio variable type, a subsidiary rod and a piston connected to a crankshaft are connected to each other through a connecting rod, and an eccentric shaft mounted at an eccentric location on a support shaft turnably carried in an engine body and the subsidiary rod are connected to each other through a control rod, so that the compression ratio of the engine is changed by changing the turned position of the support shaft. The engine further includes a one-way clutch mounted between the support shaft and the engine body for limiting the direction of turning of the support shaft. The turned position of the support shaft is limited selectively at a plurality of points by a turned-position limiting means, and a load applied to at least one of the support shaft and the turned-position limiting means is moderated by buffering means.

4 Claims, 12 Drawing Sheets

ENGINE OF COMPRESSION-RATIO VARIABLE TYPE

BACKGROUND OF THE INVENTION

1. Field of the Invention

The present invention relates to an engine of a compression-ratio variable type, comprising a connecting rod connected at one end to a piston through a piston pin, a subsidiary rod connected to a crankshaft through a crankpin and to the other end of the connecting rod, a control rod connected at one end to the subsidiary rod at a location displaced from a connected position of the connecting rod, a support shaft turnably carried in an engine body, and an eccentric shaft mounted at an eccentric location on the support shaft and connected to the other end of the control rod, the turned position of the support shaft being changed to change the compression ratio.

2. Description of the Related Art

There is a conventional engine of a compression-ratio variable type known from, for example, Japanese Patent Application Laid-open No. 9-228858, in which a subsidiary rod connected to a crankshaft and a piston are connected to each other through a connecting rod, and an eccentric shaft mounted at an eccentric location on a support shaft turnably carried in an engine body and the subsidiary rod are connected to each other through a control rod, the compression ratio of the engine being changed by changing the turned position of the support shaft.

In the conventional engine, the turned position of the support shaft is changed by driving the support shaft in turning by an actuator such as an electric motor and a cylinder, to thereby change the compression ratio. However, an expansion load and a compression load are applied to the control rod by the combustion in the engine and inertia. For this reason, a shock load is applied to the actuator such as the electric motor and the cylinder and hence, a means for moderating such a shock must be mounted between the actuator and the support shaft, resulting in a complicated arrangement.

If the direction of turning of the support shaft is limited to one direction, the support shaft can be turned utilizing the expansion load and the compression load applied to the control rod by the combustion in the engine and the inertia. With this arrangement, the actuator for driving the support shaft in turning is not required. However, a limiting means for limiting the turned position of the support shaft at a plurality of points is required, and when the turned position of the support shaft is limited, a shock is applied to contact portions of such a limiting means and the support shaft, so that it is necessary to moderate such a shock.

SUMMARY OF THE INVENTION

Accordingly, it is an object of the present invention to provide an engine of a compression-ratio variable type, wherein the support shaft is turned utilizing the combustion in the engine and the inertia, and moreover, the shock generated upon limiting of the turned position of the support shaft can be moderated in a simple arrangement.

To achieve the above object, according to a first feature of the present invention, there is provided an engine of a compression-ratio variable type, comprising a connecting rod connected at one end to a piston through a piston pin, a subsidiary rod connected to a crankshaft through a crankpin and to the other end of the connecting rod, a control rod connected at one end to the subsidiary rod at a location displaced from a connected position of the connecting rod, a support shaft turnably carried in an engine body, and an eccentric shaft mounted at an eccentric location on the support shaft and connected to the other end of the control rod, the turned position of the support shaft being changed to change the compression ratio, wherein the engine further includes a one-way clutch mounted between the support shaft and the engine body in such a manner that the direction of turning of the support shaft is limited, a turned-position limiting means for limiting the turned position of the support shaft selectively at a plurality of points, and buffering means for moderating a load applied to at least one of the support shaft and the turned-position limiting means upon changing-over of the compression ratio.

With such arrangement of the first feature, an expansion load and a compression load are applied to the control rod by the combustion in the engine and inertia, whereby the support shaft and the eccentric shaft are turned in the direction limited by the one-way clutch, when the compression ratio is changed over. Therefore, an actuator for directly turning the support shaft is not required. Moreover, the load applied to at least one of the support shaft and the turned-position limiting means when the compression ratio is changed over, can be moderated by the buffering means.

According to a second feature of the present invention, in addition to the first feature, a flywheel is secured to the crankshaft so that a rotational force is transmitted from a recoil starter to the flywheel in response to the starting operation of the engine; the buffering means comprises an output member disposed coaxially with the crankshaft in such a manner that the rotational force in the same direction as that of the recoil starter can be transmitted to the flywheel, and the rotation thereof is limited when the recoil starter is not operated, an input member coaxial with the output member, and a spiral spring mounted between the output member and the input member; and a torque transmitting means is mounted between the support shaft and the input member so that it transmits the rotational force in a direction to wind up the spiral spring from the support shaft to the input member until the completion of the winding-up of the spiral spring, but it permits the support shaft to be raced after the completion of the winding-up of the spiral spring.

With such arrangement of the second feature, when the compression ratio is changed over, the rotational torque of the support shaft is transmitted to the input member of the buffering means through the torque transmitting means, whereby forces are accumulated in the spiral spring by the winding-up of the spiral spring, and the moderation of a shock can be achieved by absorbing a load applied to the support shaft by the spiral spring. Namely, while the support shaft is turned to a next turning-inhibited position by the turned-position limiting means when the compression ratio is changed over, the rotational torques applied to the support shaft can be buffered and accumulated by the spiral spring of the buffering means. During accumulation of the force in the spiral spring, the rotation of the output member is limited, and when the recoil starter is started at the next start of the engine, the spring force accumulated in the spiral spring is transmitted from the output member to the flywheel. Thus, even if the expansion load on the recoil starter is alleviated, the engine can be started sufficiently.

According to a third feature of the present invention, in addition to the arrangement of the first feature, limiting abutments are provided on the support shaft at a plurality of points axially spaced apart from each other with their positions displaced in a circumferential direction of the support shaft; an actuator is connected to a limiting member for driving the limiting member in turning, the limiting member being carried in the engine body to constitute a portion of the turned-position limiting means so that it can be turned about an axis perpendicular to the support shaft to come into abutment alternatively against one of the limiting abutments to limit the turned position of the support shaft; and the buffering means is interposed between the limiting member and the engine body in order to moderate an axial shock upon the abutment of the alternatively selected limiting abutment against the limiting member.

With such arrangement of the third feature, the turned position of the support shaft can be limited in such a manner that the limiting member is brought into abutment against one of the plurality of limiting abutments provided on the support shaft by turning the limiting member by the actuator, whereby the compression ratio can be changed. In this case, a shock in a direction perpendicular to the support shaft is applied to the limiting member by the contact between the limiting member and one of the limiting abutments, but the shock can be moderated by a simple arrangement in which the buffering means is interposed between the limiting member and the engine body. Thus, it is possible to avoid the application of the shock to the actuator for driving the limiting member and to enhance the durability reliability, while avoiding an increase in sizes of various members such as the support shaft and the limiting member due to increases in their strengths. Moreover, it is also possible to suppress to a low level a sound generated when the limiting member is brought into contact with one of the limiting abutments.

According to a fourth feature of the present invention, in addition to the first feature, the buffering means is mounted between the support shaft and the engine body to moderate the radial load applied from the control rod to the support shaft.

With such arrangement of the fourth feature, when the compression ratio is changed over, a large load is applied to the support shaft and the turned-position limiting means, but the radial load applied to the support shaft is moderated by the buffering means. Therefore, it is possible to enhance the durability reliability, while avoiding increases in sizes of various members such as the support shaft and the turned-position limiting means due to increases in their strengths. Moreover, it is also possible to suppress to a low level a sound generated when the turned position is limited by the turned-position limiting means.

The above and other objects, features and advantages of the invention will become apparent from the following description of the preferred embodiment taken in conjunction with the accompanying drawings.

DESCRIPTION OF THE PREFERRED EMBODIMENT

The present invention will now be described by way of a preferred embodiment with reference to FIGS. 1 to 14.

Figure 1:
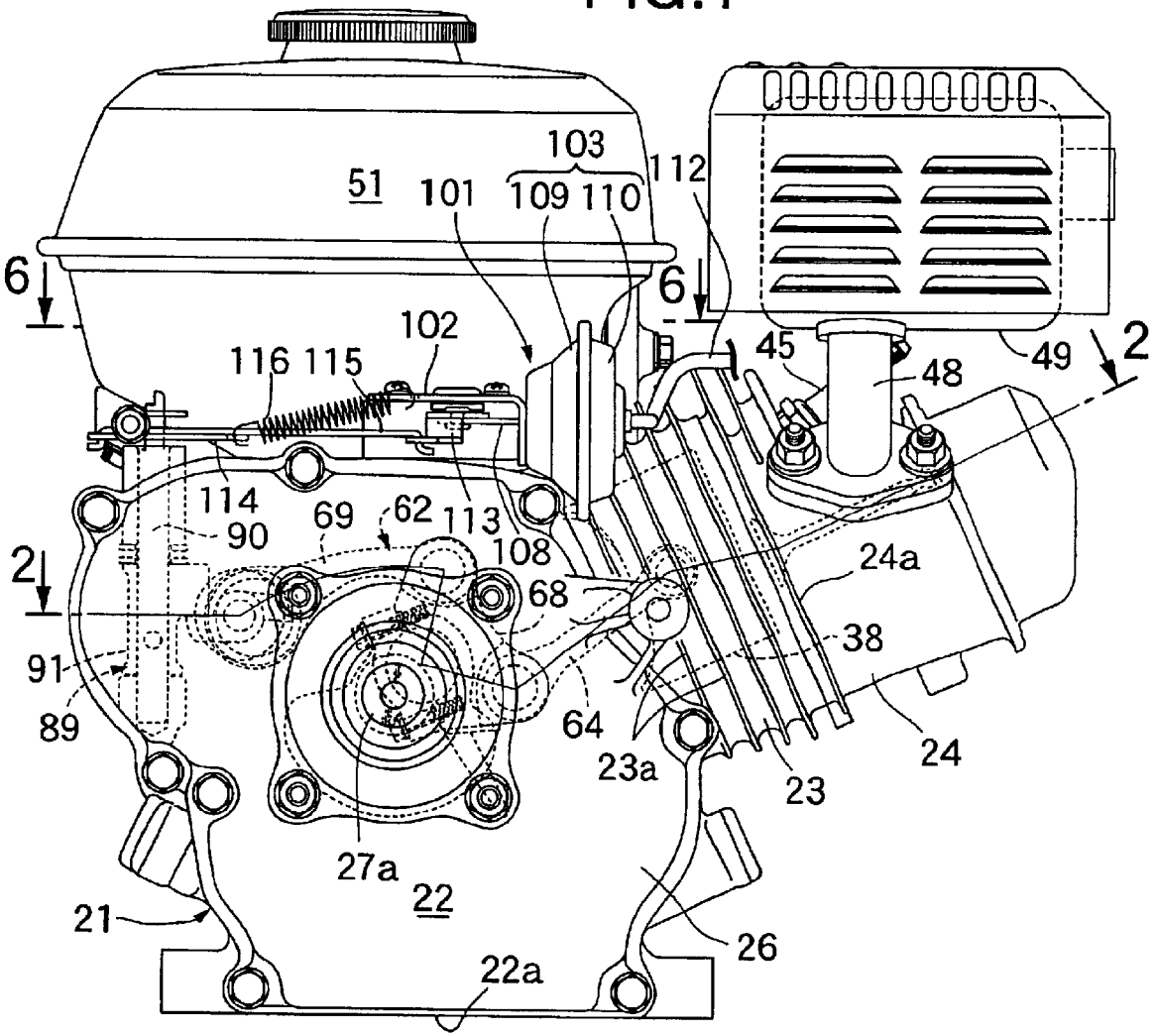
FIG. 1 is a front view of an engine.
Figure 2:
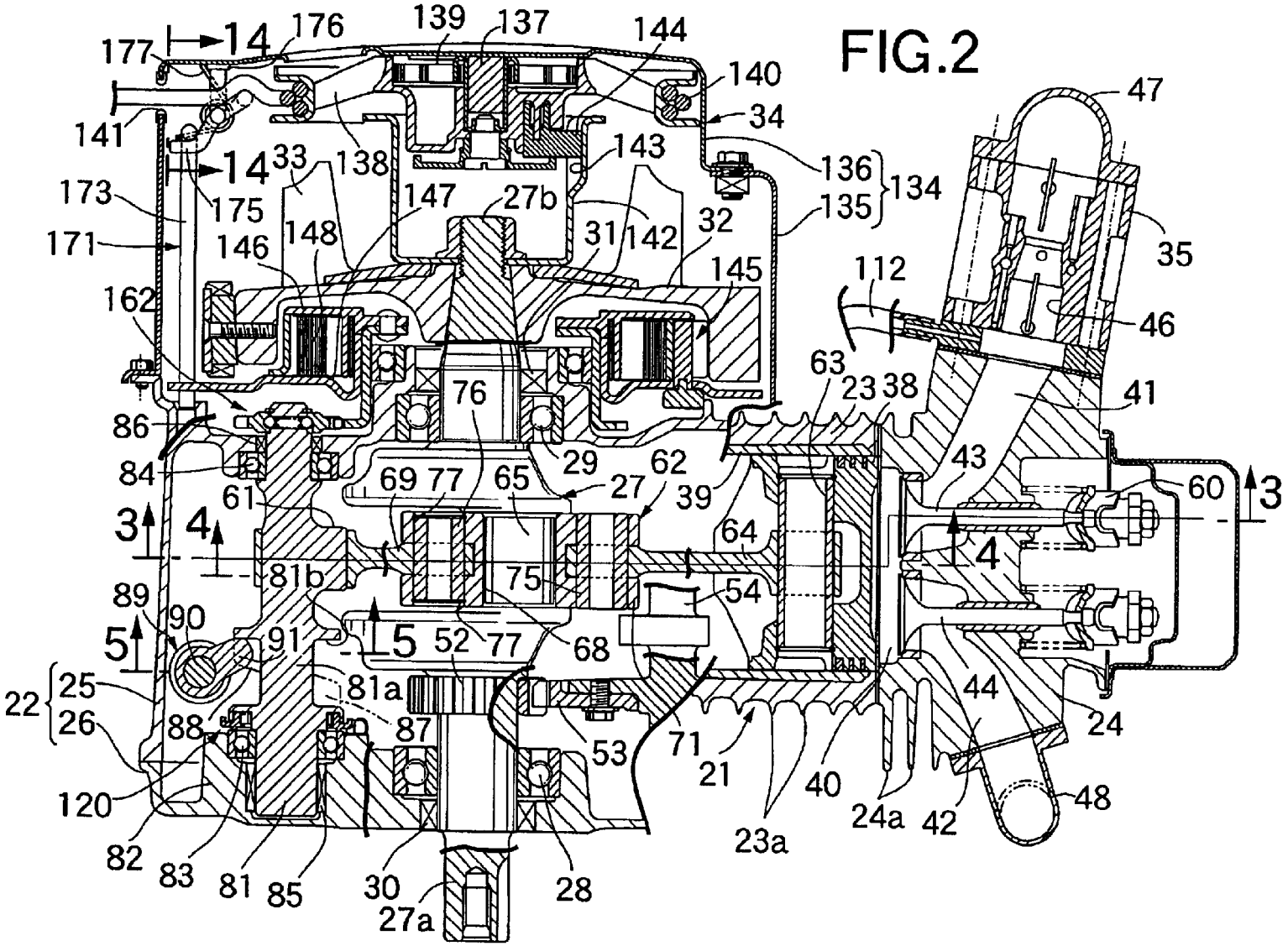
FIG. 2 is a sectional view taken along a line 2—2 in FIG. 1.
Figure 3:
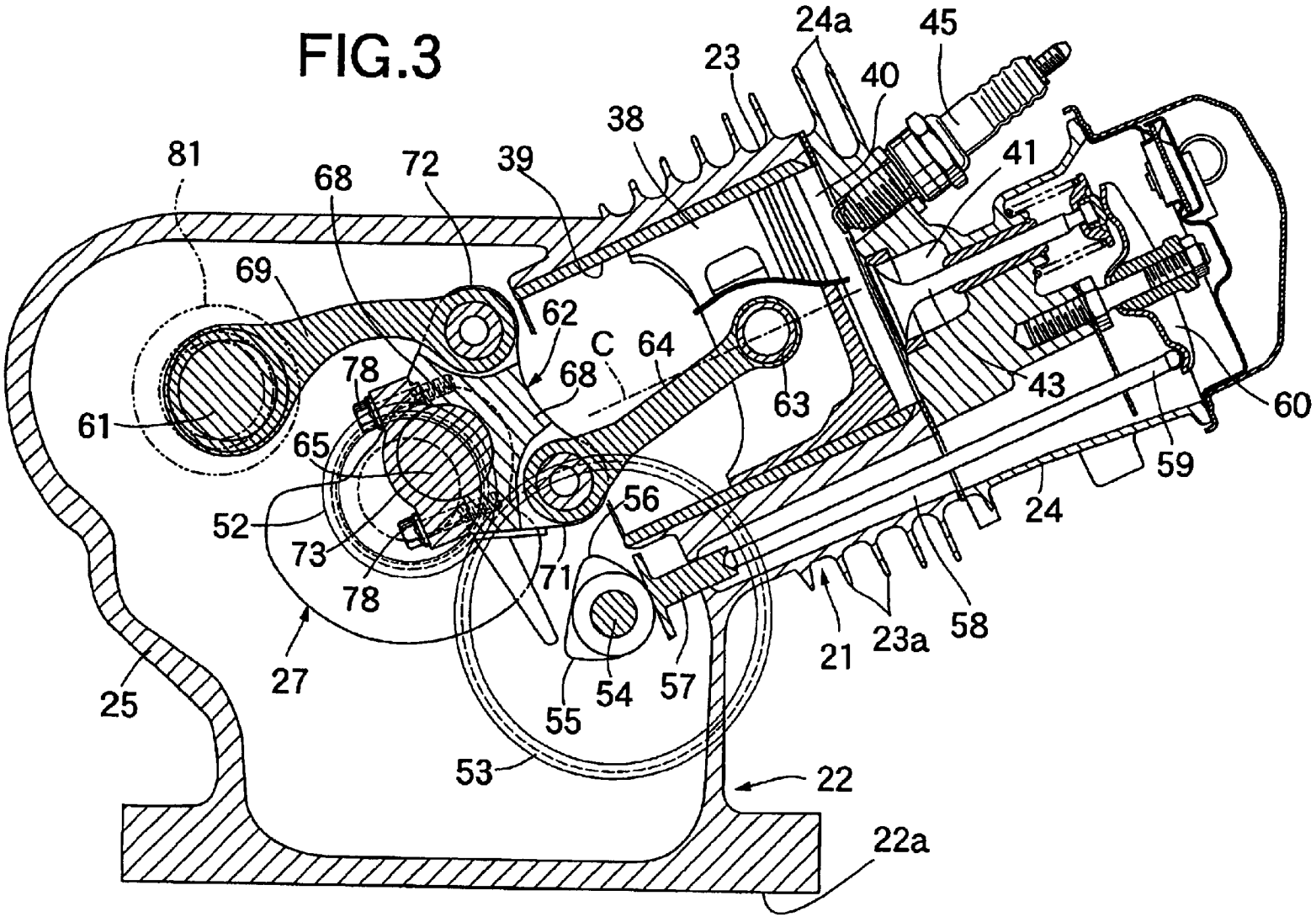
FIG. 3 is a sectional view taken along a line 3—3 in FIG. 2.

Referring first to FIGS. 1 to 3, an engine according the embodiment is an air-cooled single-cylinder engine used, for example, in a working machine or the like, and has an engine body 21 which comprises: a crankcase 22; a cylinder block 23 slightly inclined upwards and protruding from one side of the crankcase 22; and a cylinder head 24 coupled to a head of the cylinder block 23. A large number of air-cooling fins 23*a* and 24*a* are provided on outer surfaces of the cylinder block 23 and the cylinder head 24. The crankcase 22 is installed on a cylinder head of any working machine via an installation surface 22*a* of its lower face.

The crankcase 22 comprises a case body 25 formed integrally with the cylinder block 23 by casting, and a side cover 26 coupled to an open end of the case body 25. One end 27*a* of a crankshaft 27 protrudes from the side cover 26. A ball bearing 28 and an oil seal 30 are interposed between the one end 27*a* of the crankshaft 27 and the side cover 26. The other end 27*b* of the crankshaft 27 protrudes from the case body 25. A ball bearing 29 and an oil seal 31 are interposed between the other end 27*b* of the crankshaft 27 and the case body 25.

A flywheel 32 is secured to the other end 27*b* of the crankshaft 27 outside the case body 25. A cooling fan 33 for supplying cooling air to various portions of the engine body 21 is secured to the flywheel 32. A recoil starter 34 is disposed outside the cooling fan 33.

A cylinder bore 39 is formed in the cylinder block 23, and slidably receives therein a piston 38. A combustion chamber 40 is formed between the cylinder block 23 and the cylinder head 24, so that a top of the piston 38 faces the combustion chamber 40.

An intake port 41 and an exhaust port 42 capable of leading to the combustion chamber 40 are formed in the cylinder head 24. Disposed in the cylinder head 24 are an intake valve 43 openable and closable for providing connection and disconnection between the intake port 41 and the combustion chamber 40 as well as an exhaust valve 44 openable and closable for providing connection and disconnection between the exhaust port 42 and the combustion chamber 40. A spark plug 45 is threadedly mounted to the cylinder head 24 with its electrodes facing the combustion chamber 40.

A carburetor 35 is connected to an upper portion of the cylinder head 24. A downstream end of an intake passage 46 of the carburetor 35 communicates with the intake port 41.

An intake pipe 47 leading to an upstream end of the intake passage 46 is connected to the carburetor 35, and also connected to an air cleaner (not shown). An exhaust pipe 48 leading to the exhaust port 42 is connected to an upper portion of the cylinder head 24, and also connected to an exhaust muffler 49. Further, a fuel tank 51 is disposed above the crankcase 22, so that it is supported on the crankcase 22.

A driving gear 52 is formed integrally on the crankshaft 27 at a portion of the crankcase 22 closer to the side cover 26. A driven gear 53 meshed with the driving gear 52 is secured to a camshaft 54 which is rotatably carried in the crankcase 22 and which has an axis parallel to the crankshaft 27. A rotational power from the crankshaft 27 is transmitted at a reduction ratio of 1/2 to the camshaft 54 by the driving gear 52 and the driven gear 53 meshed with each other.

An intake cam 55 and an exhaust cam 56 corresponding to the intake valve 43 and the exhaust valve 44 respectively are provided on the camshaft 54. A follower piece 57 operably carried in the cylinder block 23 is in sliding contact with the intake cam 55. On the other hand, an operating chamber 58 is formed in the cylinder block 23 and the cylinder head 24, so that an upper portion of the follower piece 57 protrudes into a lower portion of the operating chamber 58. A lower end of a pushrod 59 disposed in the operating chamber 58 is in abutment against the follower piece 57. On the other hand, a rocker arm 60 is swingably carried in the cylinder head 24 with one end abutting against an upper end of the intake valve 43 biased in a closing direction by a spring. An upper end of the pushrod 59 is in abutment against the other end of the rocker arm 60. Thus, the pushrod 59 is operated axially in response to the rotation of the intake cam 55, and the intake valve 43 is opened and closed by the swinging movement of the rocker arm 60 caused in response to the operation of the pushrod 59.

A similar mechanism similar to that between the intake cam 55 and the intake valve 43 is also interposed between the exhaust cam 56 and the exhaust valve 44, so that the exhaust valve 44 is opened and closed in response to the rotation of the exhaust cam 56.

Figure 4:
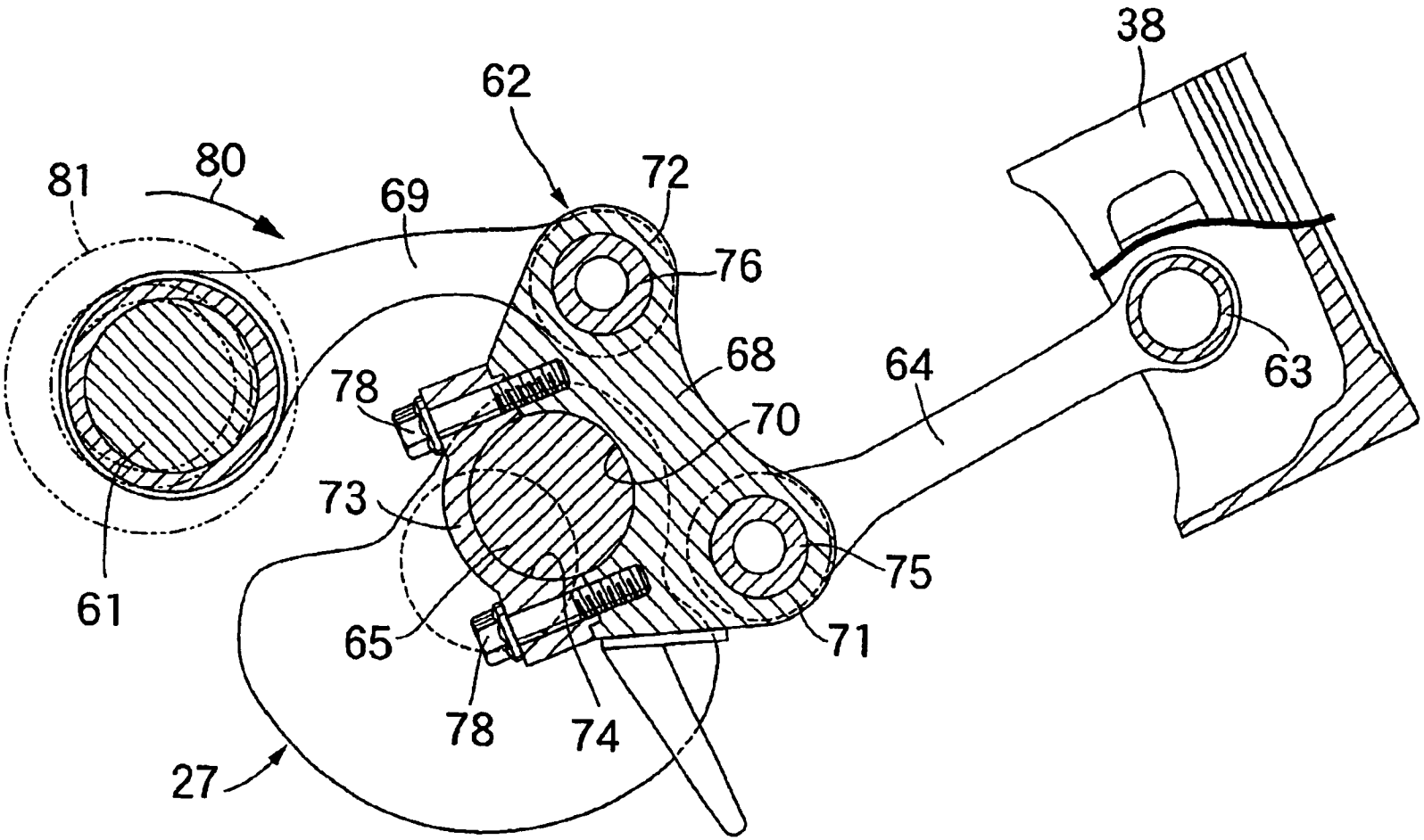
FIG. 4 is a sectional view taken along a line 4—4 in FIG. 2.

Referring also to FIG. 4, the piston 38, the crankshaft 27 and an eccentric shaft 61 carried in the crankcase 22 of the engine body 21 for displacement in a plane passing through a cylinder axis C and perpendicular to the axis of the crankshaft 27, are connected to one another through a link mechanism 62.

The link mechanism 62 comprises a connecting rod 64 connected at one end to the piston 38 through a piston pin 63, a subsidiary rod 68 connected to the crankshaft 27 through a crankpin 65 and turnably connected to the other end of the connecting rod 64, and a control rod 69 which is turnably connected at one end to the subsidiary rod 68 at a location displaced from a connected position of the connecting rod 64, and at the other end to eccentric shaft 61.

The subsidiary rod 68 has, at its intermediate portion, a first semicircular bearing portion 70 which is in sliding contact with a half of a periphery of the crankpin 65, and a pair of bifurcations 71 and 72 are provided integrally at opposite ends of the subsidiary rod 68, so that the other end of the connecting rod 64 and one end of the control rod 69 are sandwiched between the bifurcations 71 and 72. A second semicircular bearing portion 74 of a crank cap 73 is in sliding contact with the remaining half of the periphery of the crankpin 65, and the crank cap 73 is fastened to the subsidiary rod 68.

The connecting rod 64 is turnably connected at the other end to one end of the subsidiary rod 68 through a cylindrical connecting rod pin 75. The opposite ends of the connecting rod pin 75 press-fitted into the other end of the connecting rod 64, are turnably fitted into the bifurcation 71 at the one end of the subsidiary rod 68.

One end of the control rod 69 is turnably connected through a subsidiary rod pin 76 to the other end of the subsidiary rod 68. The opposite ends of the subsidiary rod pin 76, which is relatively turnably passed through one end of the control rod 69 inserted into the bifurcation 72 located at the other end of the subsidiary rod 68, are clearance-fitted into the bifurcation 72 located at the other end. Moreover, a pair of clips 77, 77 are mounted to the bifurcation 72 located at the other end, to thereby abut against opposite ends of the subsidiary rod pin 76 and inhibit the disengagement of the subsidiary rod pin 76 from the bifurcation 72.

Further, the crank cap 73 is fastened to the bifurcations 71 and 72 by pair of bolts 78 disposed on opposite sides of the crankshaft 27. The connecting rod pin 75 and the subsidiary rod pin 76 are disposed on extensions of axes of the bolts 78.

The cylindrical eccentric shaft 61 is integrally provided at an eccentric location on a support shaft 81 turnably carried in the crankcase 22 of the engine body 21 and having an axis parallel to the crankshaft 27. The support shaft 81 is turnably carried at one end on a bottomed cylindrical bearing housing 82 provided on the side cover 26 of the crankcase 22 with a ball bearing 83 interposed therebetween. The other end of the support shaft 81 is turnably passed through the case body 25 of the crankcase 22, and a ball bearing 84 is interposed between the case body 25 and the support shaft 81.

A one-way clutch 85 is mounted between the bearing housing 82 and the support shaft 81 outside the ball bearing 83. An annular seal member 86 is interposed between the case body 25 and the support shaft 81 outside the ball bearing 84.

A load in a direction to compress the control rod 69 and a load in a direction to expand the control rod 69, are alternately applied to the control rod 69 connected at the other end to the eccentric shaft 61, depending on the operational cycle of the engine. A rotational force toward one side and a rotational force toward the other side, are also applied from the control rod 69 to the support shaft 81, because the eccentric shaft 61 is provided at the eccentric location on the support shaft 81. That is, the support shaft 81 is capable of turning only in one direction shown by an arrow 80 in FIG. 4, because the one-way clutch 85 is interposed between the support shaft 81 and the bearing housing 82 on the side cover 26 of the crankcase 22.

Figure 5:
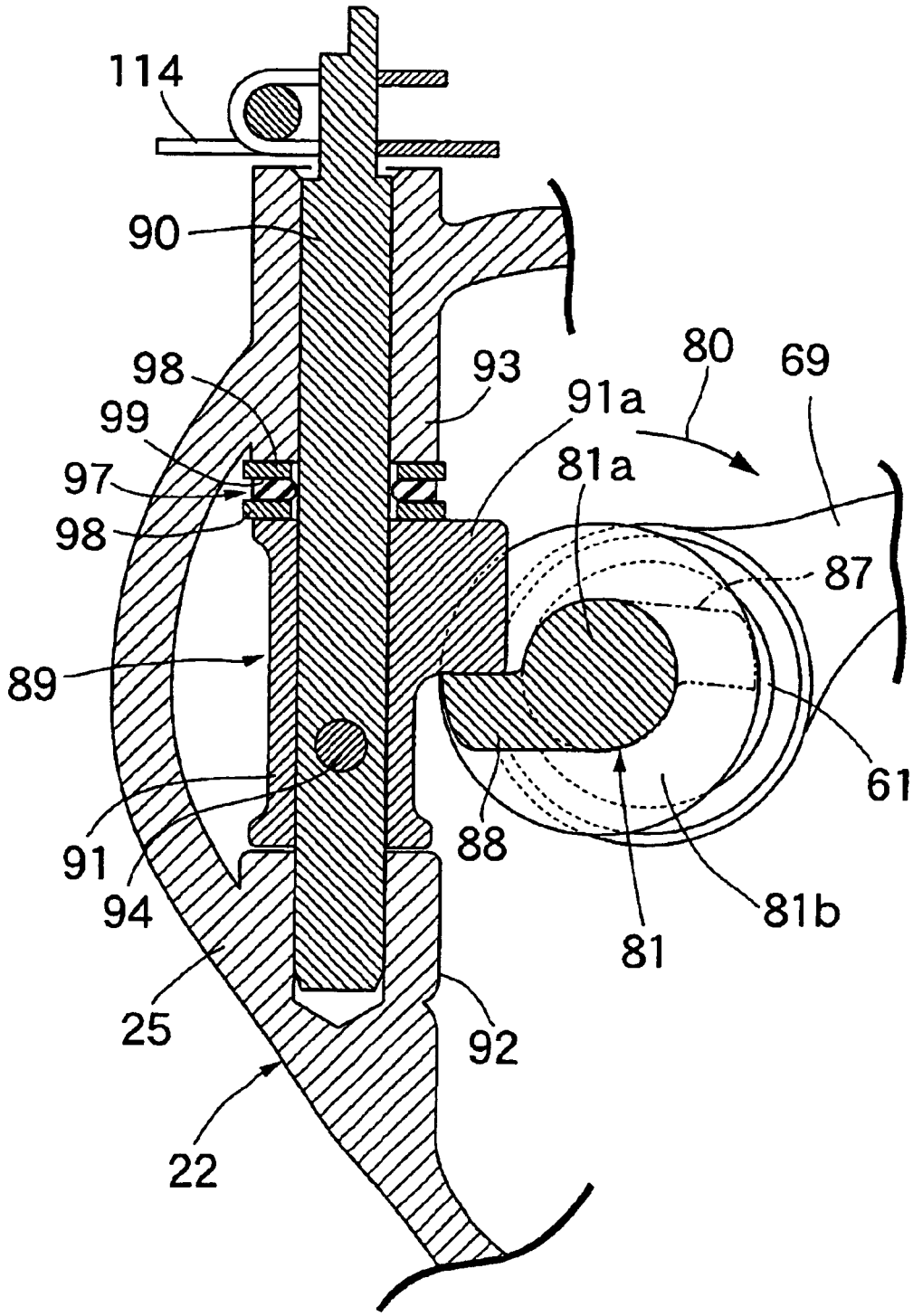
FIG. 5 is an enlarged sectional view taken along a line 5—5 in FIG. 2.

Referring also to FIG. 5, a small-diameter shaft portion 81*a* is coaxially provided on the support shaft 81 at a location axially spaced apart from the eccentric shaft 61 in such a manner that an annular recess 81*b* is formed around an outer periphery of the small-diameter shaft portion 81*a*. Limiting abutments 87 and 88 are integrally provided on the small-diameter shaft portion 81*a* at a plurality of, e.g., two points axially spaced apart from each other, with their positions displaced from each other in a circumferential direction of the support shaft 81.

Then turned position of the support shaft 81 is limited to a plurality of points, e.g., two points by a turned-position limiting means 89. The turned-position limiting means 89 comprises a turn shaft 90 turnably carried in the crankcase 22 and having an axis perpendicular to an axis of the support shaft 81, and a limiting member 91 fixed to the turn shaft 90, so that the limiting member 91 can be put into abutment alternatively against the limiting abutments 87, 88 by the rotation of the turn shaft 90.

A bottomed cylindrical shaft-supporting portion 92 and an annular shaft-supporting portion 93 are integrally provided on the case body 25 of the crankcase 22, so that they are opposed to each other at a distance on the same axis perpendicular to the axis of the support shaft 81. The turn shaft 90 having one end disposed adjacent the shaft-supporting portion 92 is turnably carried on the shaft-supporting portions 92 and 93, with the other end protruding outwards from the shaft-supporting portion 93.

The limiting member 91 is fixed by a pin 94 to the turn shaft 90 between the shaft-supporting portions 92 and 93, and is integrally provided with a projection 91*a* which is capable of protruding into the annular recess 81*b* to abut alternatively against the limiting abutments 87 and 88.

The support shaft 81 is turned by the application of a load on the control rod 69 which is connected to the eccentric shaft 61 mounted in the eccentric position on the support shaft 81, when a state in which the projection 91*a* of the limiting member 91 is in abutment against one of the limiting abutments 87 and 88 and a state in which the projection 91*a* is in abutment against the other of the limiting abutments 87 and 88 are switched over from one to the other. However, it is necessary to avoid that one of the limiting abutments 87 and 88 is put into abutment with a shock against the projection 91*a* of the limiting member 91 by the turning of the support shaft 81. Therefore, a thrust moderating means 97 for moderating the shock in an axial direction upon the abutment of the limiting abutment 87 or 88 against the alternatively selected limiting member 91, is interposed between the shaft-supporting portion 93 of the crankcase 22 and the limiting member 91.

The thrust moderating means 97 includes a ring-shaped rubber member 99 clamped between a pair of washers 98, 98, through which the turn shaft 90 is passed. The rubber member 99 has a high hardness, an oil resistance and a heat resistance, and moreover is baked to the washers 98, 98.

Figure 6:
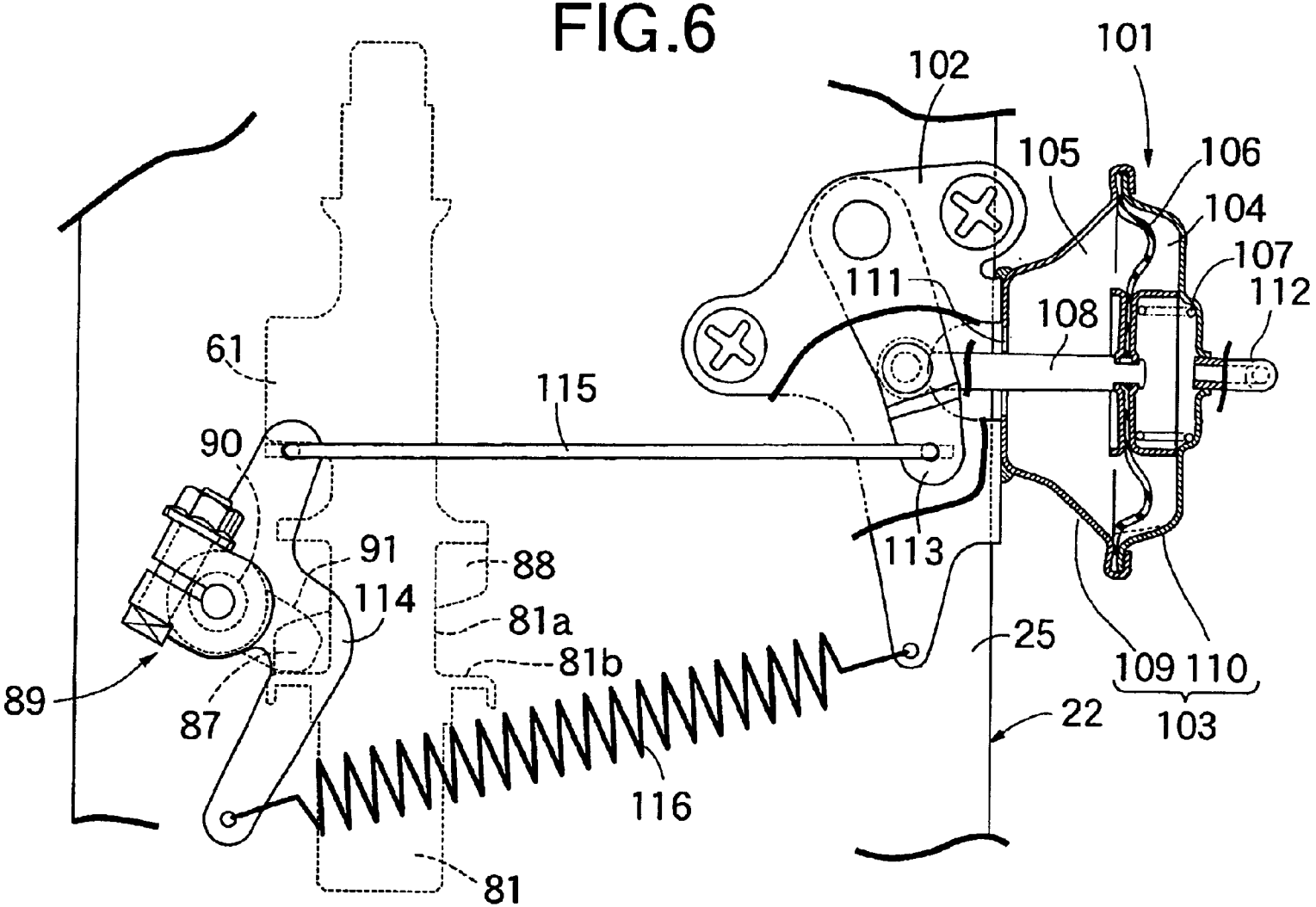
FIG. 6 is a partially cutaway plan view taken along a line 6—6 in FIG. 1 in a light load state.

Referring also to FIG. 6, a diaphragm-type actuator 101 is connected to the turn shaft 90 of the turned-position limiting means 89. The actuator 101 includes: a casing 103 mounted to a support plate 102 fastened to an upper portion of the case body 25 of the crankcase 22; a diaphragm 106 supported in the casing 103 to partition the inside of the casing 103 into a negative pressure chamber 104 and an atmospheric pressure chamber 105; a spring 107 mounted under compression between the casing 103 and the diaphragm 106 to exhibit a spring force in a direction to increase the volume of the negative pressure chamber 104; and an actuating rod 108 connected to a central portion of the diaphragm 106.

The casing 103 comprises a first bowl-shaped case half 109 mounted to the support plate 102, and a second bowl-shaped case half 110 bonded by crimping to the case half 109. A peripheral edge of the diaphragm 106 is clamped between opening edges of the case halves 109 and 110. The negative pressure chamber 104 is defined between the diaphragm 106 and the second case half 110, and accommodates therein a spring 107.

The atmospheric chamber 105 is defined between the diaphragm 106 and the first case half 109. The actuating rod 108 passed through a through-bore 111 which is provided in a central portion of the first case half 109 to protrude into the atmospheric pressure chamber 105, is connected at one end to a central portion of the diaphragm 106. The atmospheric pressure chamber 105 communicates with the outside through a clearance between an inner periphery of the through-bore 111 and an outer periphery of the actuating rod 108.

A conduit 112 leading to the negative pressure chamber 104 is connected to the second case half 110 of the casing 103, and also connected to a downstream end of the intake passage 46 in the carburetor 35. Namely, an intake negative pressure in the intake passage 46 is introduced into the negative pressure chamber 104 in the actuator 101.

The other end of the actuating rod 108 of the actuator 101 is connected to a driving arm 113 carried on the support plate 102 for turning about an axis parallel to the turn shaft 90. A driven arm 114 is fixed to the other end of the turn shaft 90 protruding from the crankcase 22. The driving arm 113 and a driven arm 114 are connected to each other through a connecting rod 115. A spring 116 is mounted between the driven arm 114 and the support plate 102, to urge the driven arm 114 to turn it in a clockwise direction in FIG. 6.

When the engine is in a light-load operational state in which the negative pressure in the negative pressure chamber 104 is high, the diaphragm 106 is flexed to decrease the volume of the negative pressure chamber 104 against spring forces of the return spring 107 and the spring 116, and the actuating rod 108 is contracted, as shown in FIG. 6. In this state, the turned positions of the turn shaft 90 and the limiting member 91 of the turned-position limiting means 89 are positions at which the projection 91*a* of the limiting member 91 is in abutting engagement with one 87 of the limiting abutments 87 and 88 of the support shaft 81.

Figure 7:
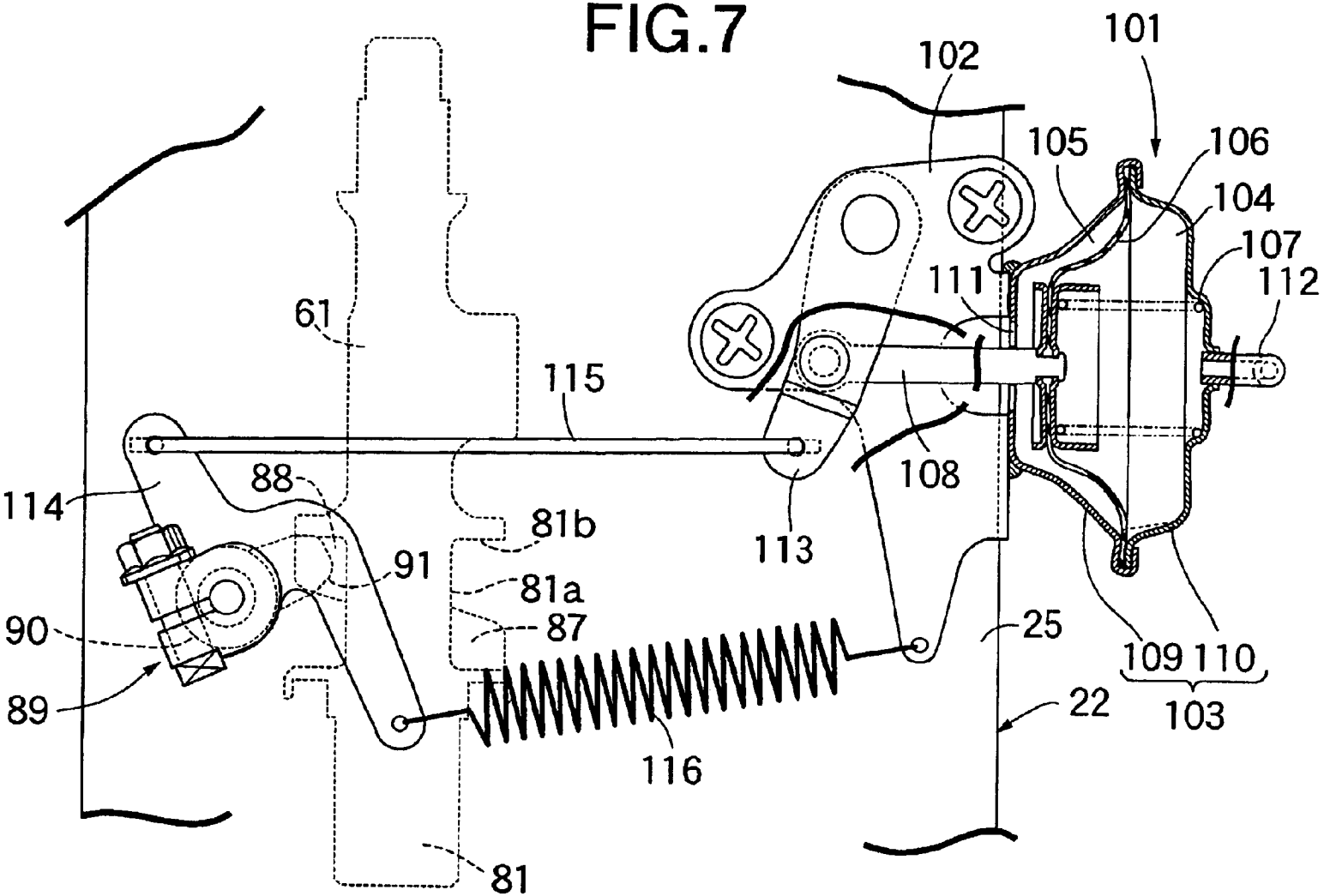
FIG. 7 is a view similar to FIG. 6, but in a heavy load state.

On the other hand, when the engine is brought into a high-load operational state in which the negative pressure in the negative pressure chamber 104 is low, the diaphragm 106 is flexed to increase the volume of the negative pressure chamber 104 by the spring forces of the return spring 107 and the spring 117, and the actuating rod 108 is expanded, as shown in FIG. 7. Thus, the turn shaft 90 and the limiting member 91 of the turned-position limiting means 89 are turned to the positions at which the projection 91*a* of the limiting member 91 is in abutting engagement with one 88 of the limiting abutments 87 and 88 of the support shaft 81.

As described above, the turning of the support shaft 81, to which the rotational force is applied in one direction during operation of the engine, is restricted to the position at which any one of the limiting abutments 87, 88 is in engagement with the projection 91*a* of the limiting member 91 by turning the limiting member 91. The eccentric shaft 61 which is in the position eccentric from the axis of the support shaft 81, i.e., the other end of control rod 69, is displaced between two positions in a plane perpendicular to the axis of the crankshaft 27 by stopping the turning of the support shaft 81 in each of two positions with phases different from each other, for example, by 167 degrees, whereby the compression ratio of the engine is changed.

Figure 8:
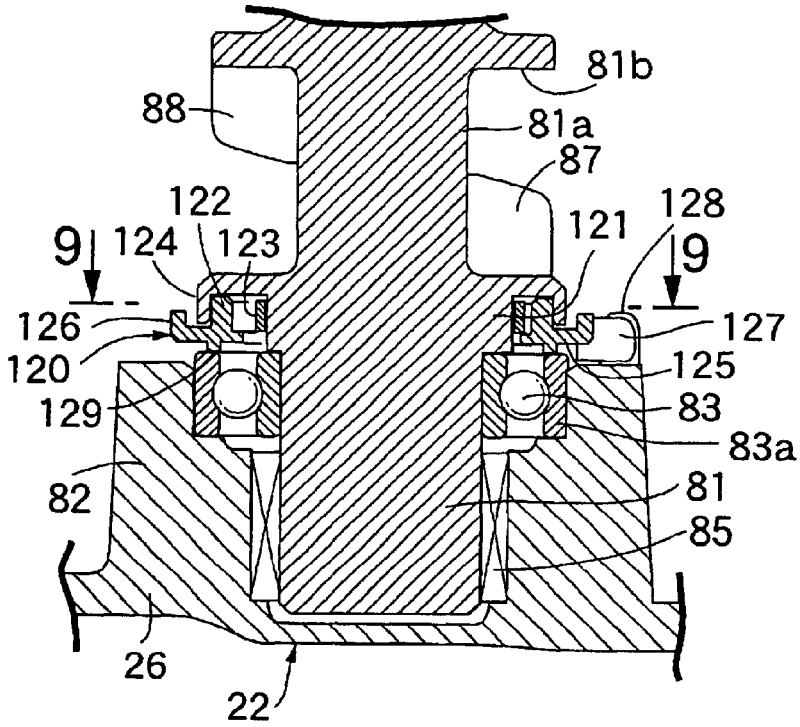
FIG. 8 is an enlarged sectional view showing an area in the vicinity of one end of a support shaft shown in FIG. 2.
Figure 9:
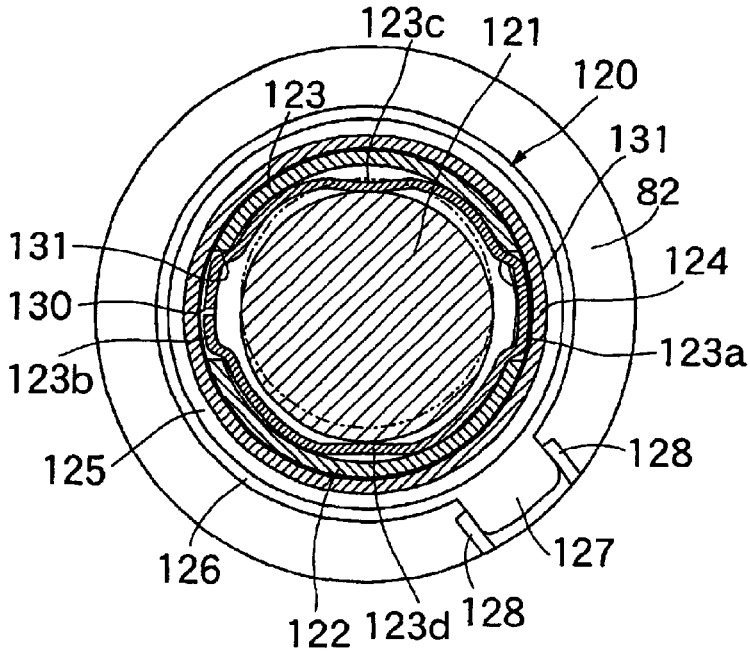
FIG. 9 is a sectional view taken along a line 9—9 in FIG. 8.

Referring to FIGS. 8 and 9, in order to avoid that the limiting abutments 87 and 88 are put into abutment with a shock alternatively against the projection 91*a* of the limiting member 91 by the turning of the support shaft 81 when the compression ratio is changed, a radial buffer means 120 for moderating a load in a radial direction applied from the control rod 69 to the support shaft 81 is mounted between one end of the support shaft 81 and the bearing housing 82 of the crankcase 22 on the engine body 21.

The radial buffer means 120 includes: an eccentric cam 121 integrally provided on the support shaft 81 so that it is located adjacent the small-diameter shaft portion 81*a* on the side of the ball bearing 83; a spring holder 122 engaged with the bearing housing 82 to surround the eccentric cam 121 so that the spring holder 122 is prevented from turning about the axis of the support shaft 81; and a compression spring

123 retained on the holder 122 to come into friction contact with the eccentric cam 121.

A cylindrical portion 124 is provided coaxially on the support shaft 81 to surround the eccentric cam 121. The spring holder 122 is slidably fitted into the cylindrical portion 124. A ring-shaped support plate 125 opposed to the ball bearing 83 and the bearing housing 82 is integrally connected to the spring holder 122. An annular projection 126 is provided integrally and projectingly at an end of the support plate 125 closer to the bearing housing 82, so that an annular groove, into which a tip end of the cylindrical portion 124 is inserted, is formed between the projection 126 and the spring holder 122, and an engagement plate portion 127 is provided integrally on the bearing housing 82 at circumferential one point to protrude radially outwards.

The engagement plate portion 127 is clamped between a pair of locking plate portions 128, 128 projectingly provided on a tip end face of the bearing housing 82, whereby the rotation of the spring holder 122 about the axis of the support shaft 81 is inhibited. Moreover, an annular abutment 129 is provided integrally and projectingly on the support plate 125 and supported in an abutting manner on an outer race 83*a* of the ball bearing 83.

The compression spring 123 is formed into a substantially endless shape and has a split groove 130 at circumferential one point, and is formed with engagement portions 123*a* and 123*b* which are bulged radially outwards in a trapezoidal shape to come into engagement in a pair of engagement bores 131, 131 provided in the spring holder 122 on one diametrical line of the support shaft 81, and a pair of flexible abutments 123*c* and 123*d* flexed radially to be able to come resiliently into sliding contact with the eccentric cam 121. The flexible abutments 123*c* and 123*d* are disposed at two points on a straight line perpendicular to a line connecting the engagement portion 123*a* and 123*b* to each other.

With the radial buffer means 120, the eccentric cam 121 turns one of the flexing abutments 123*c* and 123*d*, while flexing it, during turning of the support shaft 81, so that the radial load applied from the control rod 69 to the support shaft 81 upon the change of the compression ratio can be moderated. Moreover, the combustion in the engine is utilized when the compression ratio is changed from a lower compression ratio to a higher compression ratio, leading to a possibility that a larger shock is applied to the support shaft 81. Therefore, the amount of initial deformation of one 123*c* of the flexible abutments 123*c* and 123*d* which is brought into contact with the eccentric cam 121 during the changing of the compression ratio from the lower compression ratio to the higher compression ratio, is set larger than that of the flexible abutment 123*d*. Thus, the shock applied to the support shaft 81 during the changing of the compression ratio from the lower compression ratio to the higher compression ratio can be effectively moderated, so that it is possible to avoid that an unnecessary turning resistant torque is applied to the support shaft 81 during the changing of the compression ratio from the higher compression ratio to the lower compression ratio.

Referring again to FIG. 2, a case 134 of a recoil starter 34 comprises a case member 135 formed into a cylindrical shape to surround the flywheel 32 and fastened to the case body 25 of the crankcase 22, and a cap-shaped case member 136 fastened to the case member 135 to close an open end of the case member 135. A reel 138 is rotatably carried on a shaft 137 mounted in the case member 136 coaxially with the crankshaft 27, and a spiral spring 139 is mounted between the shaft 137 and the reel 138.

One end of a rope 140 wound around the reel 138 is tied at one end to the reel 138, and the other end of the rope 140 is drawn to the outside from an opening 141 provided in the case member 136.

A portion of the reel 138 is covered with a cap-shaped starter pulley 142 secured to one end of the crankshaft 27, and a ratchet 144 is carried on the reel 138 and capable of being engaged into a locking recess 143 provided in an inner periphery of the starter pulley 142.

Thus, when the rope 140 is pulled against a spring force of the spiral spring 139 and a pulling force is then released, the reel 138 is rotated by the spring force of the spiral spring 139, and the ratchet 144 is brought into engagement in the locking recess 143 in the starter pulley 142, whereby a starting rotational power is transmitted from the reel 138 to the crankshaft 27.

Figure 10:
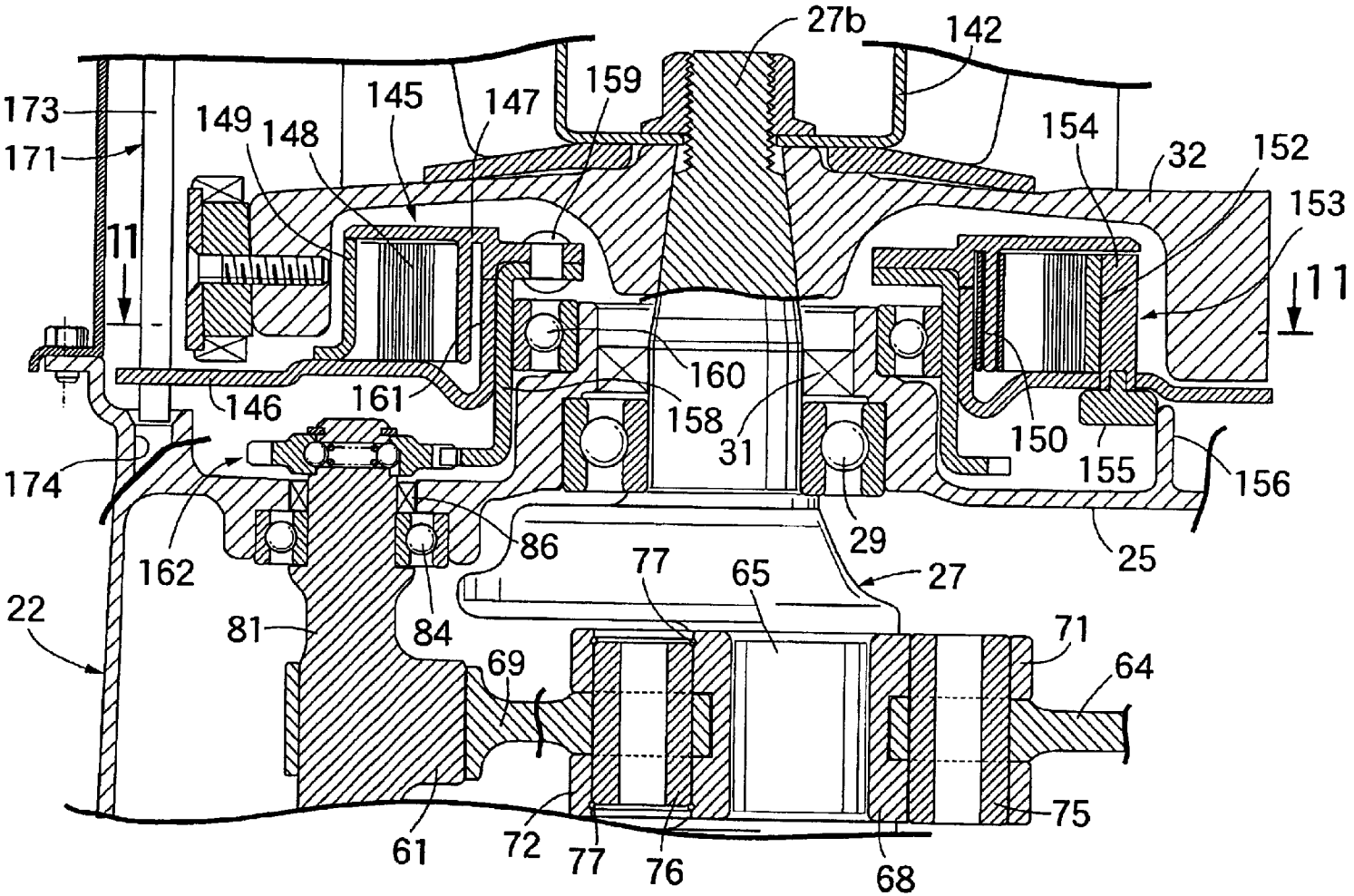
FIG. 10 is an enlarged view showing an area on the side of the other end of the support shaft and an area in the vicinity of a buffering/accumulating means shown in FIG. 2.
Figure 11:
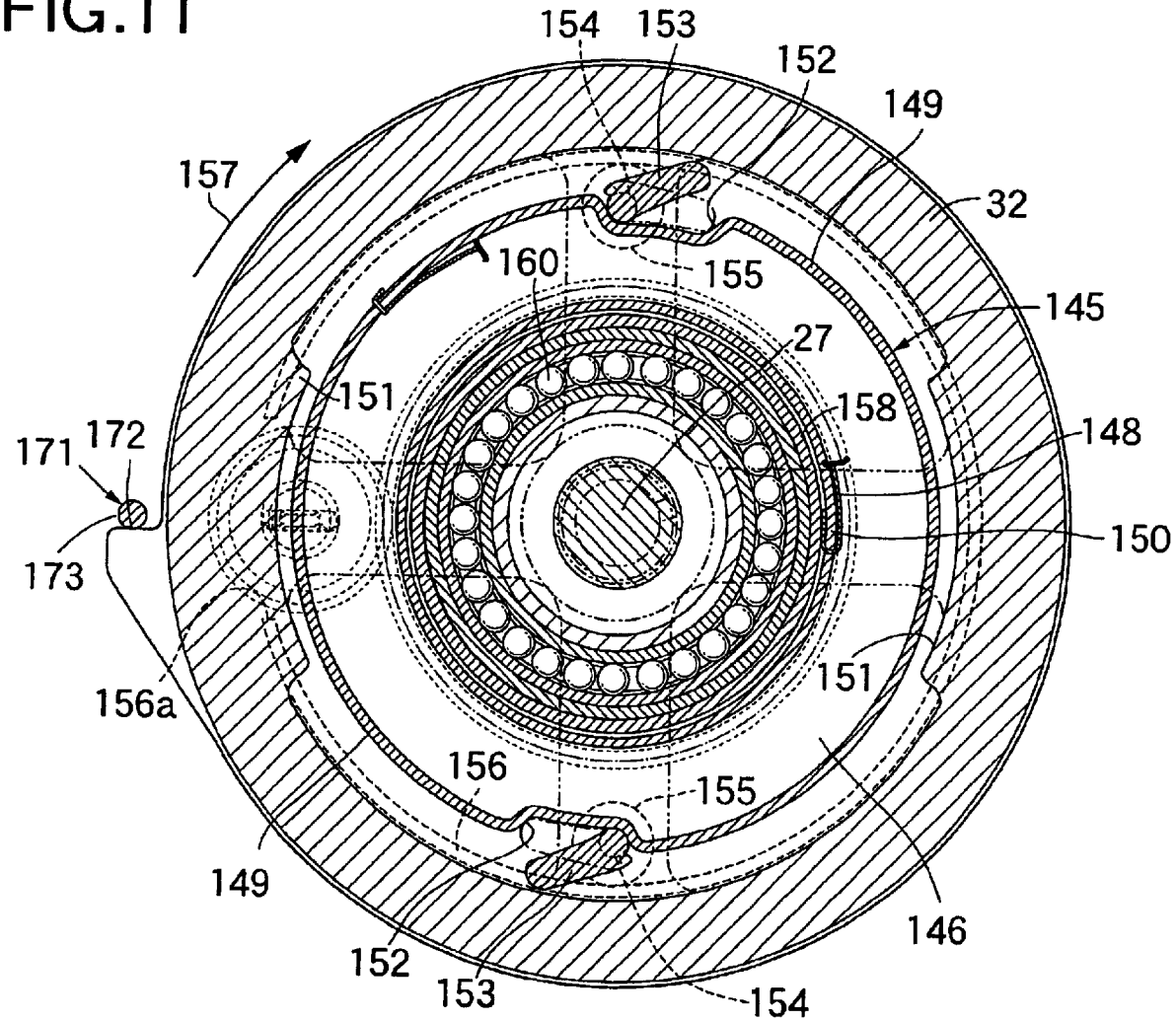
FIG. 11 is a sectional view taken along a line 11—11 in FIG. 10.

Referring to FIGS. 10 and 11, a buffering/accumulating means 145 is disposed between the case body 25 of the crankcase 22 and the flywheel 32, so that a rotational force in the same direction as that of the recoil starter 34 can be transmitted to the flywheel 32.

The buffering/accumulating means 145 includes a spiral spring 148 mounted between an output member 146 and an input member 147 disposed coaxially with the crankshaft 27. The output member 146 and the input member 147 each formed into a ring plate-shape to coaxially surround the crankshaft 27, are disposed at a distance from each other in an axial direction of the crankcase 27 with the output member 146 positioned at a location closer to the crankcase 22.

A substantially cylindrical outer tube 149 extending coaxially with the crankshaft 27 at a location corresponding to an outer periphery of the input member 147 is secured at one end to the output member 146. The intake member 147 is integrally formed with an inner tube 150 which is disposed coaxially with the crankshaft 27 inside the outer tube 149. The spiral spring 148 is accommodated in a space defined by the output member 136, the outer tube 149, the input member 147 and the inner tube 150, and connected at opposite ends in an engaging manner to the outer tube 149 and the inner tube 150.

In such buffering/accumulating means 145, the spiral spring 148 can be wound up for accumulation of power by rotating the input member 147 in a state in which the output member 146 is restrained for inhibition of the rotation thereof. If the restraint of the output member 146 is releaed while inhibiting the rotation of the input member 147, the output member 146 is rotated by an accumulated spring force of the spiral spring 148.

In order to transmit such a rotational power of the output member 146 to the flywheel 32, trapezoidal locking projections 151, 151 which protrudes radially inwards are integrally provided on an inner periphery of the flywheel 32 at a plurality of, e.g., two points circumferentially spaced at equal distances apart from each other. On the other hand, recesses 152, 152 depressed radially inwards are provided in the outer tube 149 secured to the output member 146 at a plurality of, e.g., two points circumferentially spaced at equal distances apart from each other. Ratchets 153, 153 are carried on the output member 146 to come into engagement with the locking projections 151, 151 for turning between positions in which they protrude outwards from the recesses 152, 152 and positions in which they are accommodated in the recesses 152, 152. Namely, the ratchets 153, 153 are integrally provided with shafts 154, 154 which are parallel to the crankshaft 27 and which are turnably carried on the output member 146.

Moreover, each of rollers 155, 155 is secured coaxially to one end of each of the shafts 154, 154 at a point protruding from the output member 146 toward the case body 25 of the crankcase 22. A cylindrical guide tube 156 is provided integrally and projectingly on the case body 25, so that the rollers 155, 155 are rolled on the cylindrical guide tube 156.

Thus, when the output member 146 is rotated in a direction shown by an arrow 157 in FIG. 11, the rollers 155, 155 are rolled along an inner surface of the guide tube 156, whereby the shafts 154, 154 are turned in a direction so that the ratchets 153, 153 protrude from the recesses 152, 152. The ratchets 153, 153 protruding from the recesses 152, 152 are brought into engagement with the locking projections 151, 151, respectively, thereby permitting the rotational power of the output member 146 to be transmitted to the flywheel 32.

A transmitting tube 158 disposed coaxially with the crankshaft 27 inside the inner tube 150 is fixed to an inner peripheral portion of the input member 147 by a plurality of rivets 159, and rotatably carried on the case body 25 of the crankcase 22 with a ball bearing 160 interposed therebetween. A cylindrical support tube 161 is integrally formed on an inner periphery of the output member 146 to come into sliding contact with an outer periphery of the transmitting tube 158.

A rotational torque in a direction to wind up the spiral spring 148 is transmitted from the support shaft 81 through a torque transmitting means 162 and the transmitting tube 158 to the input member 147 of the buffering/accumulating means 145.

Figure 12:
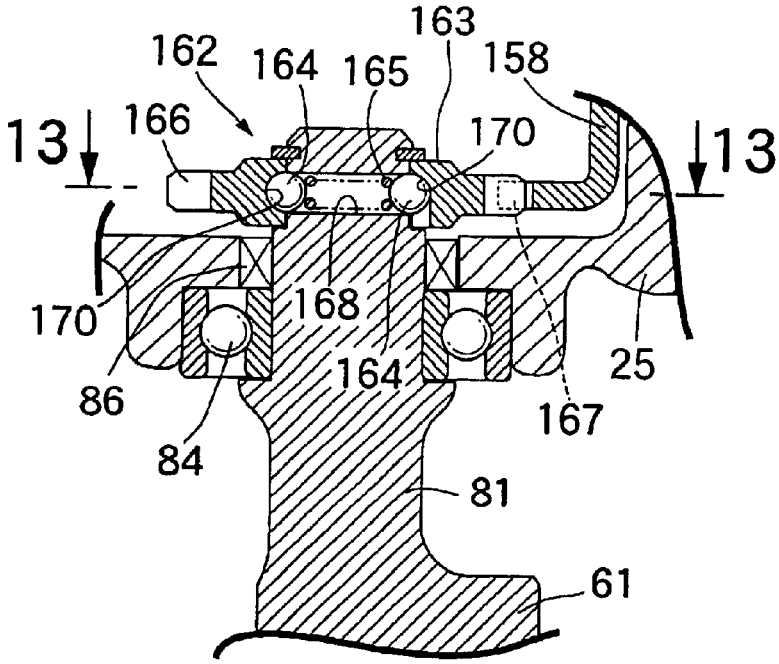
FIG. 12 is an enlarged view showing an area in the vicinity of a torque transmitting means shown in FIG. 10.
Figure 13:
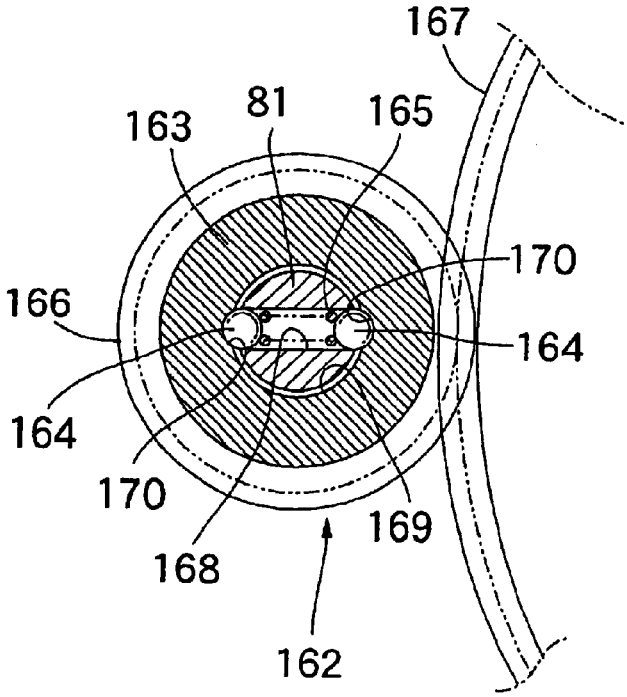
FIG. 13 is a sectional view taken along a line 13—13 in FIG. 12.

Referring to FIGS. 12 and 13, the torque transmitting means 162 is constructed so that it transmits the rotational torque in the direction to wind up the spiral spring 148 until the completion of the winding-up of the spiral spring 148, but it enables the support shaft 81 to be raced after the completion of the winding-up of the spiral spring 148. The torque transmitting means 162 includes: a ring member 163 surrounding the support shaft 81 at a portion protruding from the case body 25 of the crankcase 22; a pair of balls 164, 164 capable of being switched over between a state in which both of them are in engagement with the support shaft 81 and the ring member 163 and a state in which they are out of engagement with the ring member 163 and retained on the support shaft 81; a spring 165 mounted between the balls 164, 164 to exhibit a spring force for biasing the balls 164, 164 in directions to bring them into engagement with the support shaft 81 and the ring member 163; a driving gear 166 integrally provided on an outer periphery of the ring member 163; and a driven gear 167 integrally provided on the transmitting tube 158 to become meshed with the driving gear 166.

The ring member 163 surrounds the support shaft 81 with its axial position determined constant. A through-bore 158 is provided in the support shaft 81 at a location corresponding to the ring member 163, and extends along one diametrical line. On the other hand, an annular groove 169 and a pair of locking recesses 170, 170 are provided in an inner periphery of the ring member 163. The locking recesses 170, 170 are formed so that they are depressed outwards from the annular groove 169 on one diametrical line of the ring member 163.

A portion of each of the balls 164, 164 is inserted into each of opposite ends of the through-bore 169. The spring 165 is accommodated in the through-bore 169, so that it is interposed between the balls 164, 164. The annular groove 169 is formed to have a depth enough to roll the balls 164, 164 accommodated by half in the opposite ends of the through-bore 169. The locking recesses 170, 170 are formed into semi-circular shapes in such a manner that the balls 164, 164 accommodated substantially by half in the opposite ends of the through-bore 169 are engaged therein.

In such torque transmitting means 162, the rotational torque of the support shaft 81 is transmitted to the input member 147 through the ring member 163, the driving gear 166, the driven gear 167 and the transmitting tube 158, by the turning of the support shaft 81 in a state in which the balls 164, 164 are engagement in the locking recesses 170, 170, i.e., in a state in which the balls 164, 164 are in engagement with the support shaft 81 and the ring member 163. Therefore, in the buffering/accumulating means 145 which is in a state in which the rotation of the output member 146 is inhibited, the spiral spring 148 is wound up.

Moreover, the spring force of the spiral spring 148 serves as a resistance, and the radial load applied from the control rod 69 to the support shaft 81 upon the changing of the compression ratio can be moderated, so that the torque transmitting means 162 also functions as a radial buffering means.

After the completion of the winding-up of the spiral spring 148, when support shaft 81 is turned upon the changing of the compression ratio, the support shaft 81 is raced to repeat the state in which the balls 164, 164 are in engagement in the locking recesses 170, 170 and a state in which the balls 164, 164 are rolled in the annular groove 169. The radial load applied from the control rod 69 to the support shaft 81 upon the changing of the compression ratio can be moderated by a resisting force generated when the balls 164, 164 climbs over the locking recesses 170, 170 into the annular groove 169 against the spring force of the spring 165. Therefore, even in this case, the torque transmitting means 162 also functions as the radial buffering means.

In the present embodiment, a notch 156*a* is provided in the guide tube 156 at a location corresponding to the torque transmitting means 162 for avoiding the interference of the guide tube 156 with the torque transmitting means 162.

The rotation of the output shaft 146 of the buffering/accumulating mans 145 is limited by an accumulation releasing/restricting means 171. The accumulation releasing/restricting means 171 inhibits the rotation of the output member 146 during non-operation of the recoil starter 34, but permits the rotation of the output member 146 upon the starting operation of the recoil starter 34.

Figure 14:
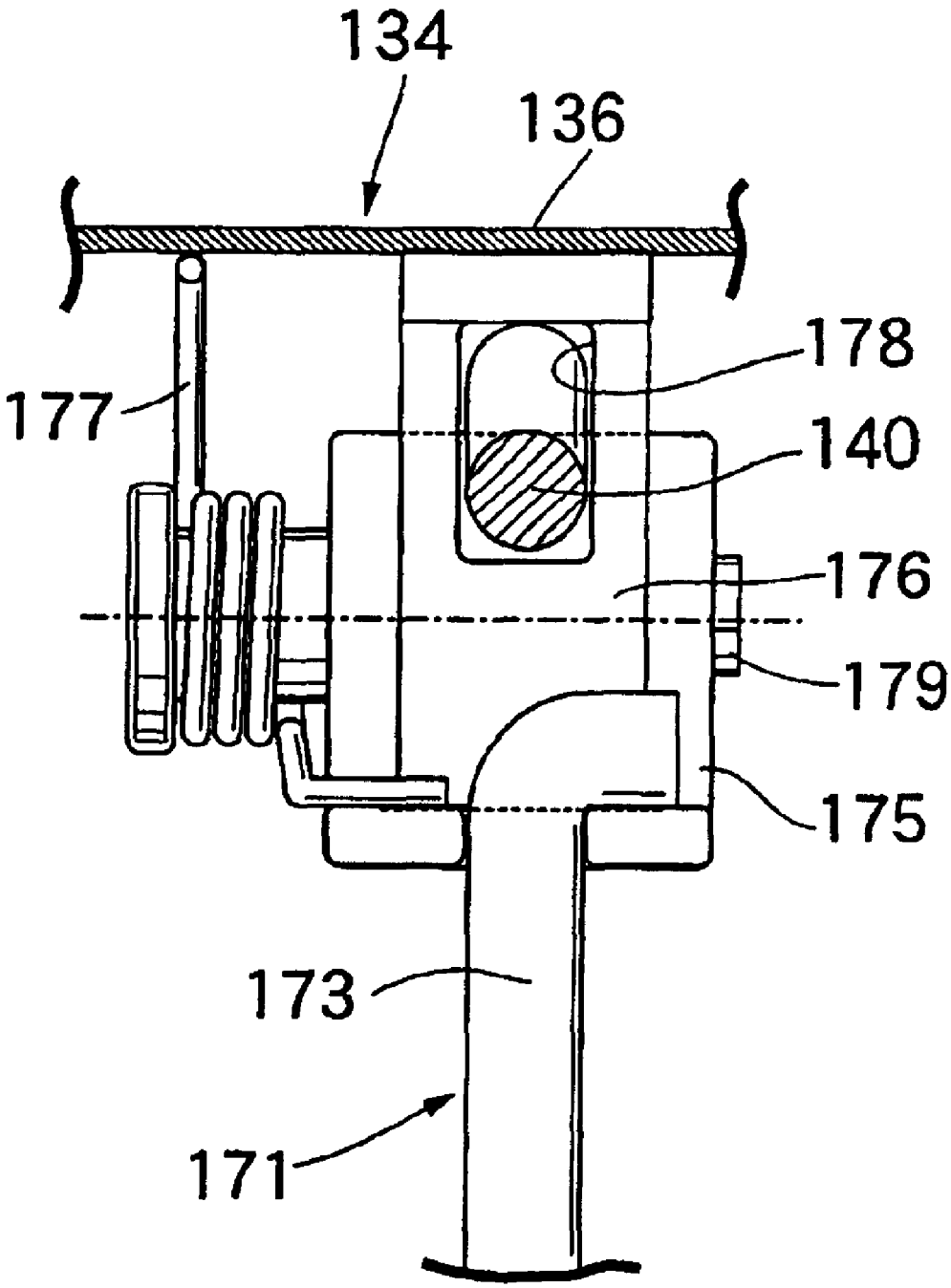
FIG. 14 is a sectional view taken along a line 14—14 in FIG. 2.

Referring also to FIG. 14, the accumulation releasing/restricting means 171 includes a limiting step 172 provided around an outer periphery of the output member 146 to face a downstream in a rotational direction shown by an arrow 157 in FIG. 11, a limiting rod 173 extending in parallel to the crankshaft 27 to inhibit the rotation of the output member 146 by the engagement with the limiting step 172 with its one end being in engagement in an engagement bore 174 provided in the case body 25 of the crankcase 22, a swinging arm 175 which is swingably carried on a support member 176 fixed to the case member 135 of the case 134 of the recoil starter 34, and one end of which is engaged with the other end of the limiting rod 173, and a return spring 177 mounted between the case member 135 and the swinging arm 175 to exhibit a spring force for biasing the limiting rod 173 in a direction to bring one end of the limiting rod 173 into engagement in the engagement bore 174.

The support member 176 is secured to an inner surface of the case member 135 in the vicinity of the opening 141, and has an insertion bore through which the rope 140 of the recoil starter 32 passes. The swinging arm 175 formed to sandwich the support member 176 from opposite sides is swingably carried at its intermediate portion on the support member 176 through a shaft 179 perpendicular to the limiting rod 173. The return spring 177 is a torsion spring, and is mounted between the case member 135 and the swinging arm 175 to surround the shaft 179.

In a state in which the recoil starter 34 is not operated, the swinging arm 175 has been turned by a spring force of the return spring 177 to a position at which the rope 140 is sandwiched between the other end of the swinging arm 175 and the support member 176. In this state, the limiting rod 173 which is at a position with end thereof being engaged in the engagement bore 174, is in engagement with the limiting step 172 to inhibit the rotation of the output member 176.

When the rope 140 of the recoil starter 34 is pulled to start the engine in such state, an urging force is applied from the rope 140 to the other end of the swinging arm 175 by tightening of the rope 140, whereby the swinging arm 175 is turned against the spring force of the return spring 177, so that the limiting rod 173 is engaged from the engagement bore 174. Thus, one end of the limiting rod 173 is brought into a free state, and the limiting rod 173 is brought into a state in which it is swingably supported at the other end on the swinging arm 175. Therefore, the output member 146 is brought into a state in which the rotation thereof is permitted, so that when the spiral spring 148 retains accumulated force, the output member 146 is rotated.

The operation of the present embodiment will be described below. The direction of turning of the support shaft 81 having the eccentric shaft 61 in the eccentric position, to which the control rod 69 has been connected, is limited to one direction by the one-way clutch 85 mounted between the side cover 26 of the crankcase 22 in the engine body 21 and the support shaft 81, and an expansion load and a compressing load are applied to the control rod 69 by the combustion in the engine and inertia. Therefore, when the compression ratio is changed, the support shaft 81 and the eccentric shaft 61 are turned in the direction limited by the one-way clutch 85.

The turned position of the support shaft 81 is limited selectively at a plurality of, e.g., two positions by the turned-position limiting means 89, and the compression ratio of the engine is changed by changing the turned position of the support shaft 81.

Moreover, the rotational force is transmitted from the recoil starter 34 to the flywheel 32 secured to the crankshaft 27 in response to the starting operation of the engine. The rotational torque in the same direction as that of the recoil starter 34 can be transmitted to the flywheel 32 from the buffering/accumulating means 145 including the spiral spring 148 mounted between the output member 146 and the input member 147 disposed coaxially with the crankshaft 27. The torque transmitting means 162, which is capable of transmitting the rotational torque in the direction to wind up the spiral spring 148 from the support shaft 81 to the input member 146 until the completion of the winding-up of the spiral spring 148, but permitting the support shaft 81 to be raced after the completion of the winding-up of the spiral spring 148, is mounted between the support shaft 81 and the input member 146. The rotation of the output member 146 of the buffering/accumulating means 145 is inhibited by the accumulation releasing/restricting means 171 when the recoil starter is not operated, and the accumulation releasing/restricting means 171 permits the rotation of the output member 146 in response to the starting operation of the recoil starter 34.

Therefore, when the compression ratio is changed over, the rotational torque of the support shaft 81 is transmitted through the torque transmitting means 162 to the input member 147 of the buffering/accumulating means 145. Thus, the force can be accumulated in the spiral spring 148 by the winding-up of the spiral spring 148, and the load applied to the support shaft 81 can be absorbed by the spiral spring 148, thereby contributing to the moderation of the shock. Namely, while the support shaft 81 is turned to a next turning-limited position by the turned-position limiting means 89 upon the change-over of the compression ratio, the rotational torque applied to the support shaft 81 can be accumulated by the spiral spring 148 of the buffering/accumulating means 145. During the accumulation of the force in the spiral spring 148, the rotation of the output member 146 is inhibited by the accumulation releasing/restricting means 171, but when the recoil starter 34 is started at the next start of the engine, the accumulation releasing/restricting means 171 permits the rotation of the output member 146. Therefore, the spring force accumulated in the spiral spring 148 is transmitted from the output member 146 to the flywheel 32, so that even if the pulling load on the recoil starter 34 is alleviated, the engine can be started sufficiently.

The turning-limiting means 89 is adapted to abut alternatively against the limiting abutments 87, 88 provided on the support shaft 81 with their positions circumferentially displaced from each other, to thereby limit the turned position of the support shaft 81. The turning-limiting means 89 has the limiting member 91 which is carried on the case body 25 of the crankcase 22 on the engine body 21 and which is capable of turning about the axis perpendicular to the support shaft 81. The actuator 101 for driving the limiting member 91 to turn is connected to the limiting member 91. The thrust buffering means 97 for moderating the shock in the axial direction upon the abutment of the limiting abutment 87 or 88 against the alternatively selected limiting member 91 is interposed between the limiting member 91 and the shaft-supporting portion 93 of the case body 25.

When one of the limiting abutments 87 and 88 and the limiting member 91 are brought into contact with each other, a shock is applied to the limiting member 91 in a direction perpendicular to the axis of the support shaft 81, but such a shock can be moderated by a simple construction in which the thrust buffering means 97 is interposed between the limiting member 91 and the shaft-supporting portion 93 of the case body 25. Thus, it is possible to avoid the application of the shock to the actuator 101 for driving the limiting member 91 and to enhance the durability reliability, while avoiding the increases in sizes of various members such as the support shaft 81 and the limiting member 91 due to the increasing of their strengths. Moreover, it is also possible to suppress to a low level a sound generated when one of the limiting abutments 87 and 88 and the limiting member 91 are brought into contact with each other.

The radial buffering means 120 for moderating the radial load applied from the control rod 69 to the support shaft 81 is mounted between the support shaft 81 and the side cover 26 of the crankcase 22 on the engine body 21. The torque transmitting means 162 also functioning as the radial buffering means is mounted between the buffering/accumulating means 145 and the support shaft 81.

Therefore, when the compression ratio is changed over, even if a large load is applied to the support shaft 81 and the turned-position limiting means 89, the radial load applied to the support shaft 81 is moderated by the radial load buffering means 120 and the torque transmitting means 162. Thus, it is possible to enhance the durability reliability, while avoiding the increases in sizes of various members such as the support shaft 81 and the turned-position limiting means 89 due to the increasing of their strengths. Moreover, it is possible to suppress to a low level a sound generated when the turned position is limited by the turned-position limiting means 89.

Although the embodiment of the present invention has been described in detail, it will be understood that the present invention is not limited to the above-described embodiment, and various modifications in design may be made without departing from the spirit and scope of the invention defined in the claims.

What is claimed is:

1. An engine of a compression-ratio variable type, comprising a connecting rod connected at one end to a piston through a piston pin, a subsidiary rod connected to a crankshaft through a crankpin and to the other end of said connecting rod, a control rod connected at one end to said subsidiary rod at a location displaced from a connected position of said connecting rod, a support shaft turnably carried in an engine body, and an eccentric shaft mounted at an eccentric location on said support shaft and connected to the other end of said control rod, the turned position of the support shaft being changed to change the compression ratio, wherein the engine further includes a one-way clutch mounted between said support shaft and said engine body in such a manner that the direction of turning of said support shaft is limited, a turned-position limiting means for limiting the turned position of said support shaft selectively at a plurality of points, and buffering means for moderating a load applied to at least one of said support shaft and said turned-position limiting means upon changing-over of said compression ratio.

2. An engine of a compression-ratio variable type according to claim 1, wherein a flywheel is secured to said crankshaft so that a rotational force is transmitted from a recoil starter to said flywheel in response to the starting operation of the engine; said buffering means comprises an output member disposed coaxially with said crankshaft in such a manner that the rotational force in the same direction as that of said recoil starter can be transmitted to said flywheel, and the rotation thereof is limited when said recoil starter is not operated, an input member coaxial with said output member, and a spiral spring mounted between said output member and said input member; and a torque transmitting means is mounted between said support shaft and said input member so that it transmits the rotational force in a direction to wind up the spiral spring from said support shaft to said input member until the completion of the winding-up of said spiral spring, but it permits said support shaft to be raced after the completion of the winding-up of said spiral spring.

3. An engine of a compression-ratio variable type according to claim 1, wherein limiting abutments are provided on said support shaft at a plurality of points axially spaced apart from each other with their positions displaced in a circumferential direction of said support shaft; an actuator is connected to a limiting member for driving said limiting member in turning, said limiting member being carried in the engine body to constitute a portion of said turned-position limiting means so that it can be turned about an axis perpendicular to said support shaft to come into abutment alternatively against one of said limiting abutments to limit the turned position of said support shaft; and said buffering means is interposed between said limiting member and the engine body in order to moderate an axial shock upon the abutment of the alternatively selected limiting abutment against said limiting member.

4. An engine of a compression-ratio variable type according to claim 1, wherein said buffering means is mounted between said support shaft and the engine body to moderate the radial load applied from said control rod to said support shaft.

* * * * *